US005098568A

United States Patent [19]

Tyson

[11] Patent Number: 5,098,568

[45] Date of Patent: Mar. 24, 1992

[54] SEPTIC TANK SYSTEM WITH CONTROLLABLE DISTRIBUTION MEANS

[76] Inventor: James E. Tyson, 10621 Six Forks Rd., Raleigh, N.C. 27614

[21] Appl. No.: 435,967

[22] Filed: Nov. 13, 1989

[51] Int. Cl.[5] ..... B01D 21/24

[52] U.S. Cl. ..... 210/519; 137/876; 138/92; 210/170; 210/532.2

[58] Field of Search ..... 210/519, 520, 533-535, 210/532.2, 170; 137/561 A, 872, 876; 138/92

[56] References Cited

U.S. PATENT DOCUMENTS

| | | | |
|---|---|---|---|
| 162,382 | 4/1875 | Hess | 137/876 |
| 3,497,067 | 2/1970 | Tyson | 210/519 X |
| 4,169,491 | 10/1979 | Bajka | 137/876 X |
| 4,605,501 | 8/1986 | Tyson | 210/532.2 X |
| 4,679,983 | 7/1987 | Pietryk et al. | 137/876 X |

*Primary Examiner*—Richard L. Chiesa
*Attorney, Agent, or Firm*—Rhodes, Coats & Bennett

[57] ABSTRACT

An improved distribution joint for a septic tank system includes a fixed flow divider to apportion the effluent between two or more absorption fields. An adjustable flow control valve varies the relative amounts distributed between the two fields without disturbing the effluent and distribution lines or the junction itself.

2 Claims, 3 Drawing Sheets

SEPTIC TANK SYSTEM WITH CONTROLLABLE DISTRIBUTION MEANS

FIELD OF THE INVENTION

This invention relates to septic tank systems and more particularly to effluent distribution lines used with the absorption field of a septic tank system.

BACKGROUND OF THE INVENTION

Septic tank systems normally include a septic tank and a distribution system for expelling effluent from the septic tank through the distribution system into one or more absorption fields. A limiting condition on the effectiveness and capacity of the septic tank system is the absorption capacity of the absorption fields. When the amount of effluent exceeds the capacity of the absorption field saturation of the field and possible back-up of the septic tank results. This problem has forced may people to unnecessarily limit the size of their septic tanks and the amount of effluent expelled from septic tank.

In the past, the main methods used to increase the absorption capacity of a septic tank system was to add additional absorption fields and to provide a plurality of distribution outlets for directing the effluent to these different absorption fields. However, difficulty has been encountered in controlling the proportion of the total effluent directed to each absorption field. U.S. Pat. No. 3,497,067 disclosed a solution to this problem which includes a flow divider that equally divides the effluent between two absorption fields. In this system each absorption field receives approximately equal amounts of effluent. This solution is usually effective in preventing saturation. Nevertheless, in some instances one absorption field will become saturated before the other. Therefore, some type of control means is needed to direct effluent in any desired proportions to respective absorption fields.

SUMMARY AND OBJECTS OF THE INVENTION

The septic tank system of the present invention increases the capacity of a plurality of absorption fields to absorb effluent by providing accurate, variable control means for directing septic tank effluent in adjustable proportions between two or more absorption fields. The variable control of the septic tank system can be adjusted throughout the life of the system and allows effluent to be dispersed in any chosen proportion to the different absorption fields. By directing varying proportions of effluent to the different absorption fields, efficient utilization of all fields is promoted. Underutilization of some fields while others saturated and back-up is prevented.

The major elements of the present invention include a septic tank, an effluent line, leading from the septic tank, a distribution joint, and two or more distribution lines leading to respective absorption fields. The effluent from the septic tank typically flows by gravity through an effluent line and then into the distribution joint. The distribution joint includes an inlet portion and an outlet portion which intersects with one another. The inlet portion is disposed higher than the outlet portion so that the septic tank effluent spills down into the outlet portion. In order to equally divide the effluent, the present invention uses a flow divider located at the intersection of the inlet portion and outlet portion to divide the effluent in approximately equal amounts. This helps prevent large variations in effluent flow in the opposing distribution lines caused by varying slopes and conditions of the distribution lines.

To get more exact and alterable effluent control through the separate distribution lines, a unique rotatable flow director is used. As the absorption capacity of one field decreases the control sleeve can be rotated to direct more of the effluent to the other field thereby giving the saturated field time to dry. Structurally, the flow director of the present invention is a cylindrical control sleeve which is fitted inside the inlet portion of the distribution joint. An opening is formed in the lower portion of the flow director. The effluent flows through the control sleeve bottom before spilling into the outlet portion. As the effluent spills into the outlet portion it is divided by the flow divider in the chosen proportion.

To aid in accurately directing effluent to each outlet in the chosen proportion, the flow director is designed with directing flanges. The directing flanges are located along the edges of the bottom opening of the flow director. As the effluent flows through the bottom opening of the flow director, it tends to adhere to the outer surface of the sleeve and flow by adhesion back across the flow divider. The tendency of the effluent to adhere to the outer surface of the control sleeve makes it more difficult to correctly position the flow director to direct the chosen proportion of effluent to the desired fields. The directing flanges help minimize this problem by preventing effluent from adhering to the outer surface of the control sleeve.

In view of the above, it is an object of the present invention to provide an effluent distribution means including a means to control the flow in one outlet or distribution line relative to the other.

Another object of the present invention is to provide a means for controlling the effluent flow to distribution lines without having to remove the same from the ground.

Another object of the present invention is to provide a readily adjustable effluent flow control for use in conjunction with a flow divider means.

Another object of the present invention is to provide an effluent flow control which is inexpensive to produce and yet is highly efficient in accomplishing the intended results.

Other objects and advantages of the present invention will become apparent and obvious from a study of the following description and the accompanying drawings which are merely illustrative of such invention.

DETAILED DESCRIPTION

Figure 1:
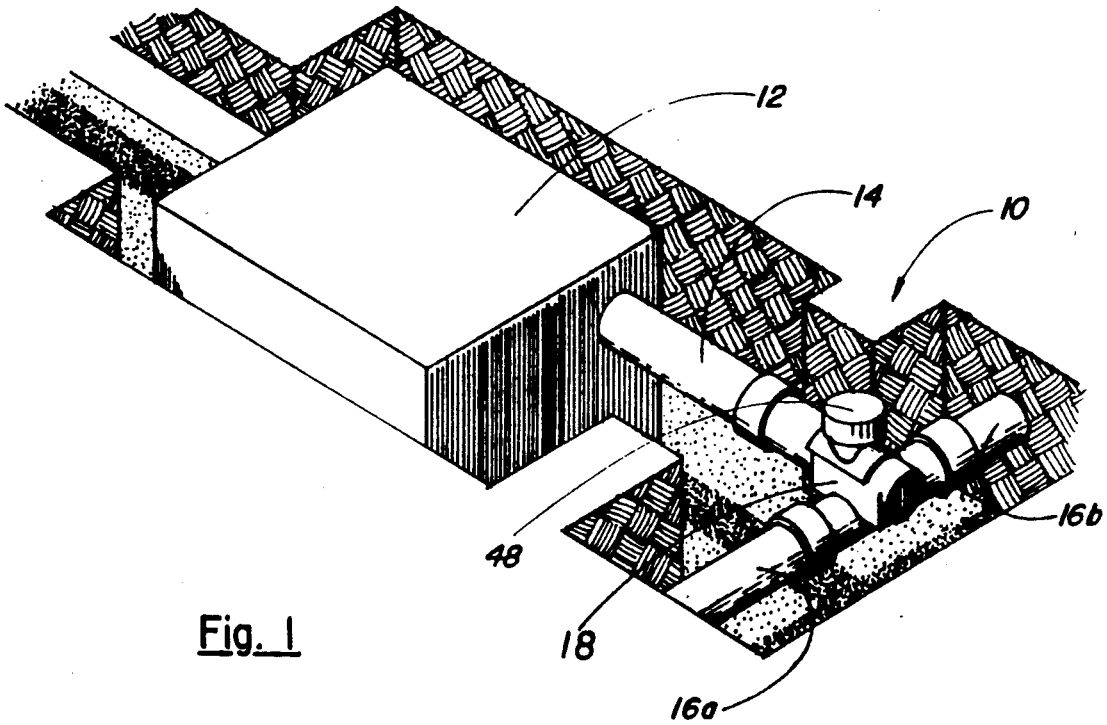
FIG. 1 is a perspective view of the septic tank system of the present invention.
Figure 2:
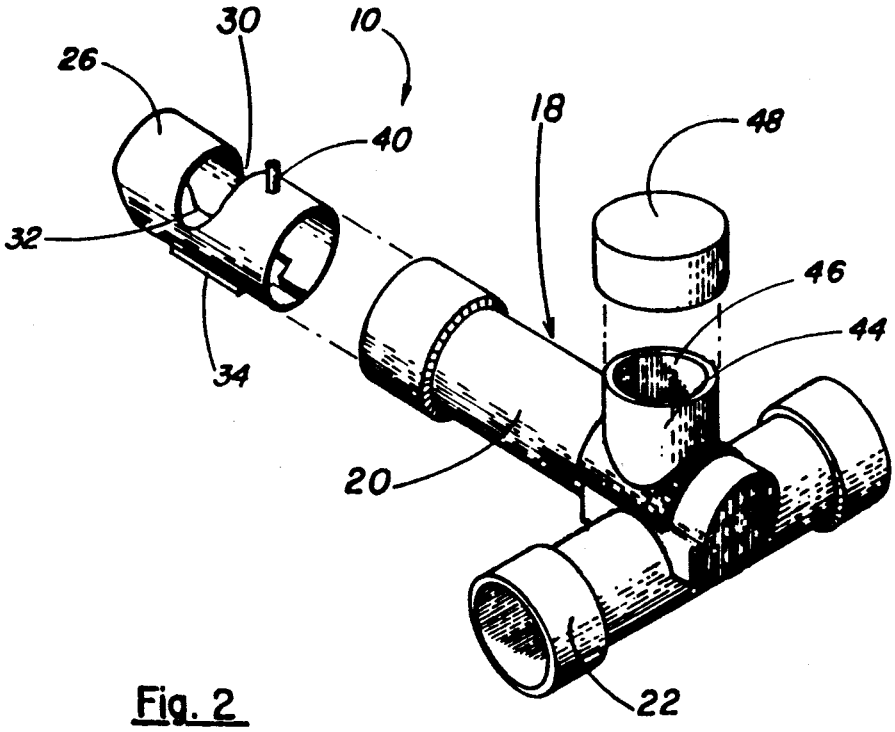
FIG. 2 is a perspective view of the distribution assembly with this control sleeve removed.
Figure 3:
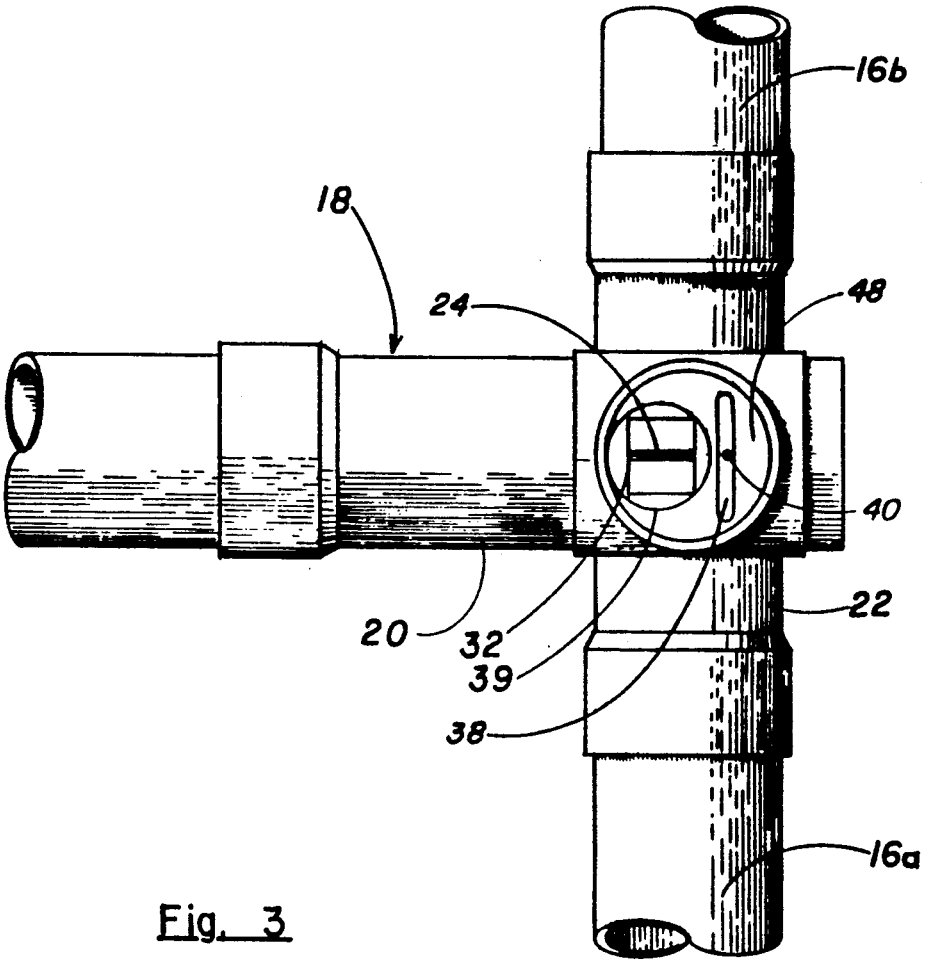
FIG. 3 is a top plan view of the distribution assembly.

With further reference to the drawings, and particularly to FIG. 1, the improved septic tank system of the present invention is indicated generally at 10. The septic tank system 10 includes a septic tank 12, an effluent line 14 leading from the septic tank, a distribution joint 18, and two or more distribution lines 16*a* and 16*b* leading to respective absorption fields (not shown) 16. As shown by the drawings, effluent line 14 is connected to the septic tank 12 at one end and to the distribution joint 18 at the other end. The septic tank effluent typically flows by gravity from the septic tank 12, through effluent line 14, and to the distribution joint 18. Within the distribution joint 18 the effluent is divided in desired amounts between distribution lines 16*a* and 16*b*.

Figure 4:
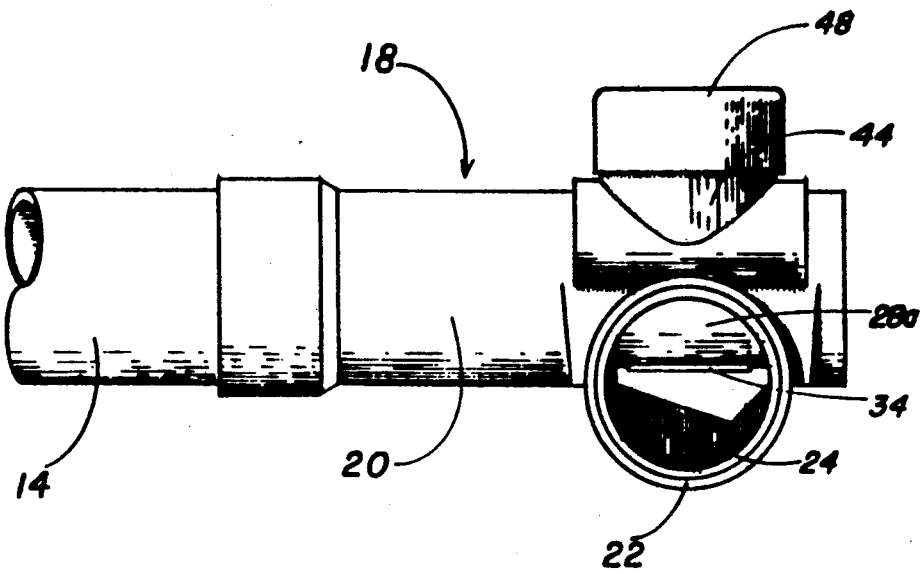
FIG. 4 is an elevation view of the distribution assembly.

Referring now to FIGS. 2–6, the design of the distribution joint 18 is shown. The distribution joint 18 includes an inlet line 20 and an outlet line 22. The inlet line 20 is open on one end and closed on the other end. The open end connects to the terminal end of the effluent line 14. The outlet line 22 is open on both ends and intersects the inlet line 20 at a intermediate portion thereof. This intermediate portion is sometimes referred to herein as the throat area. As shown best in FIGS. 5 and 6, the bottom portion of the inlet line 20 is disposed above the bottom portion of the outlet line 22. A flow divider 24 extends across the outlet line 22 in the throat area. Preferably, the upper edge of the flow divider 24 slopes downwardly away from the inlet line 20 as shown in FIG. 4. Effluent flows from the inlet line 20 and spills onto the flow divider thereby dividing the effluent between right and left halves of the outlet line 22. The flow divider 24 is described in detail in U.S. Pat. No. 3,497,067 which is incorporated herein by reference.

A cylindrical control sleeve or flow director 26 is rotatively mounted inside the effluent line 14 and is used to direct effluent from the inlet line 20 into the outlet line 22. Flow director 26 is a thin-walled cylindrical sleeve which is split along its lower extent to form a bottom opening 30. The bottom opening 30 directs effluent from the inlet line 20 into the outlet line 22 where the flow divider 24 divides the effluent. Extending along the edges of the bottom opening 30 are directing flanges 34. Directing flanges 34 prevent effluent from adhering to and flowing along the outer surface of the flow director 26. Instead, the flanges 34 direct the effluent downwards to assist in apportioning the desired amounts of the effluent to respective sides of flow divider 24.

Figure 5:
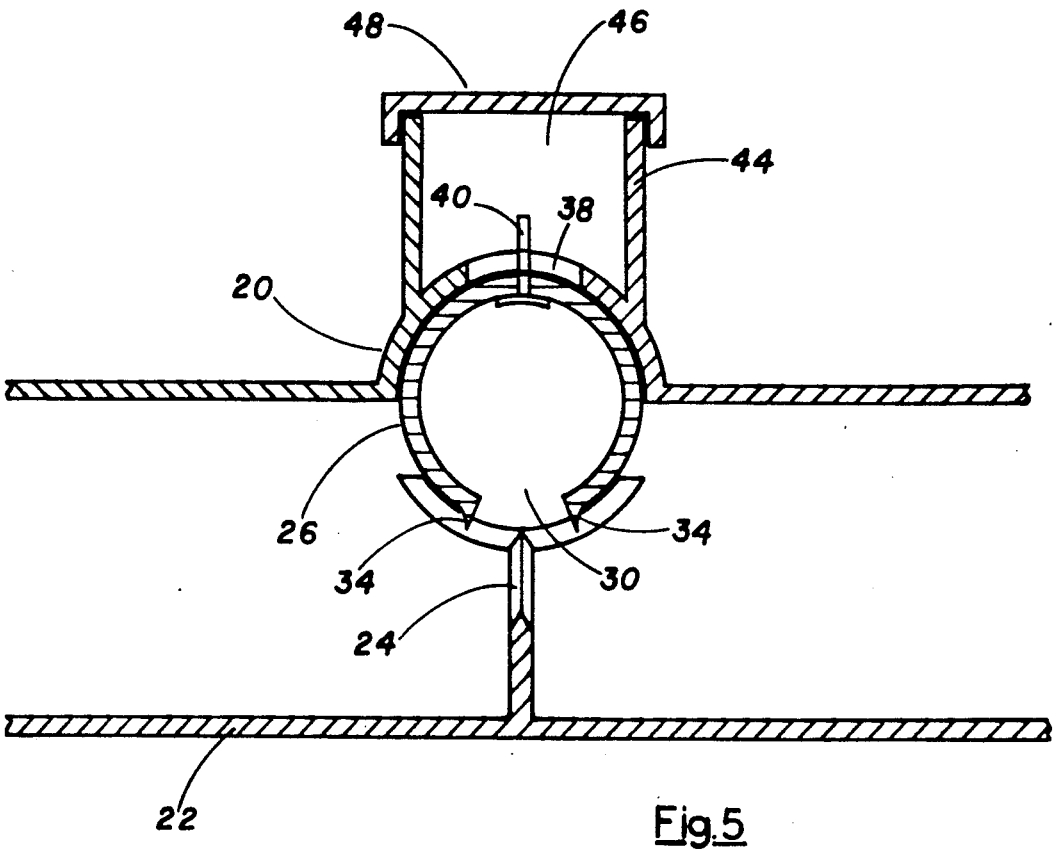
FIG. 5 is a section view taken through line A—A of FIG. 3 showing the control sleeve in a central position.

When the control sleeve is centered, as shown in FIG. 5, the effluent is equally divided between opposite sides of the outlet line 22. In order to reapportion the effluent, the flow director 26 is rotated to change the positioning of the bottom opening 30 and hence the direction of the effluent flowing out of the opening 30.

Figure 6:
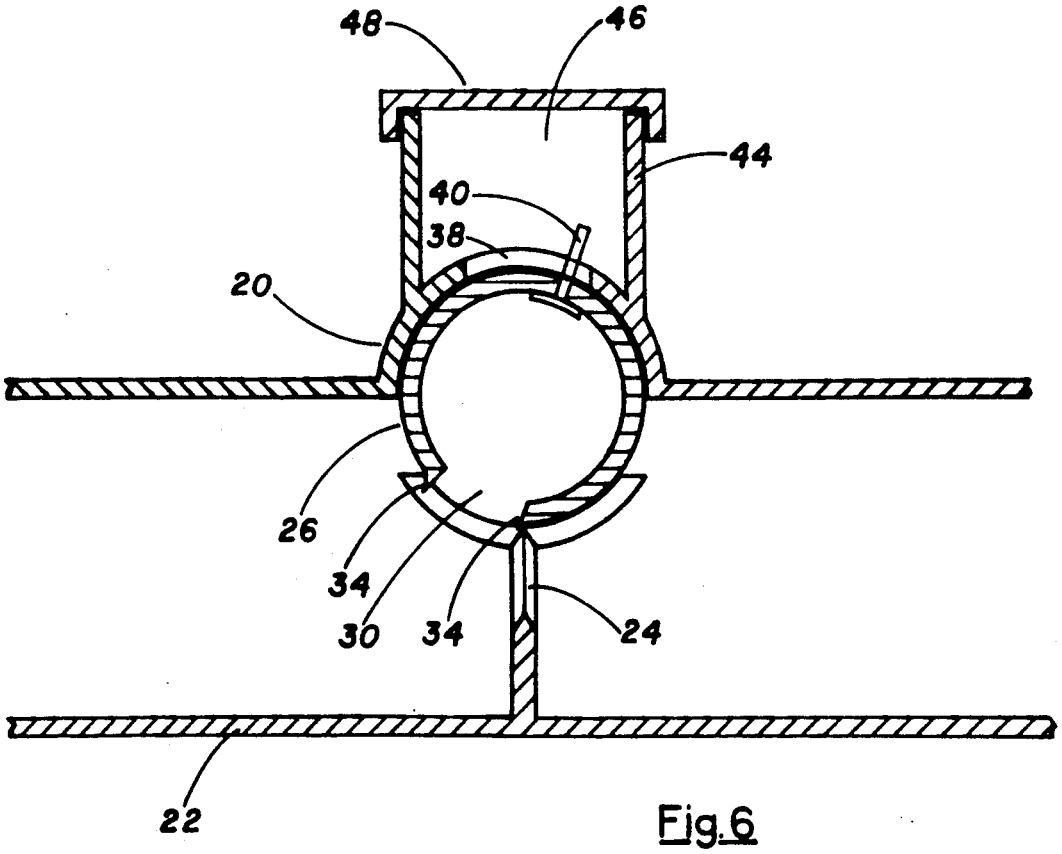
FIG. 6 is a section view taken through line A—A of FIG. 3 showing the control sleeve rotated to one side.

In FIG. 6, the flow director 26 is shown in a position to direct all of the effluent to one side of the outlet line 22. In this position, the effluent has a greater tendency to adhere to the outer surface of the flow director 26 and flow back across the flow divider 24 before dropping. The directing flanges 34 prevent the back flow of effluent and thus assures apportionment of the effluent in the intended amounts.

To change the position of the control sleeve 26, an adjustment peg 40 projects upwardly from the control sleeve 26 through a slot 38 in the top portion of the effluent line 14. The peg 40 can be grasped between two fingers and rotated to position the control sleeve 26 in the desired position. So that the position of the control sleeve can be observed, an opening 30 is formed in the top of the control sleeve 26. A second opening 39 is formed in the top portion of the effluent line 14. The edges of the bottom opening 30 can be sighted through opening 30 and 39. It is appreciated, however, that non-visual means for determining the position of the control sleeve 26 may also be used.

In the preferred embodiment, a vertical access tube 44 rises upwardly from the effluent line 14 to the earth's surface. The access tube 44 encloses both the adjustment peg slot 38 and opening 39, and is large enough in diameter to insert one's hand into. A cap 48 is insertable onto the open end of the access tube 44 and provides a means of access.

The present invention may, of course, be carried out in other specific ways than those herein set forth without departing from the spirit and essential characteristics of the invention. The present embodiment are, therefore, to be considered in all respects as illustrative and not restrictive and all changes coming within the meaning and equivalency range of the appended claims are intended to be embraced therein.

I claim:

1. A distribution joint for a septic tank system comprising:

(a) an inlet line having an inlet opening positioned to be connected to an effluent line of a septic tank;

(b) an outlet line in fluid communication with said inlet line and having two outlet openings at opposite ends thereof positioned to be connected to respective distribution lines;

(c) wherein the inlet line and the outlet line are offset so that a bottom portion of the inlet line intersects a top portion of the outlet line;

(d) a flow divider disposed in a bottom portion of the outlet line below the intersection with the inlet line for dividing the effluent flowing from the inlet line into the outlet line, wherein the flow divider extends generally parallel to the axis of the inlet line; and (e) a generally cylindrical flow director rotatably mounted in said inlet line and having an end opening for receiving effluent flowing through said inlet line and a bottom opening generally perpendicular to the end opening and bounded by first and second edges for directing the effluent into the outlet line; said first and second edges being normally disposed on opposite sides of the flow divider when the flow director is in a central position;

(f) wherein the flow director is rotatable in a first direction to a position in which said first edge is rotated beyond the flow divider so that all the effluent is directed to the second outlet and wherein said flow director is rotatable in a second direction to a position in which said second edge is rotated beyond the flow divider so that all the effluent is directed to the first outlet.

2. The distribution joint according to claim 1 further including a pair of directing flanges extending along the first and second edges of the bottom opening for preventing the back flow of effluent along an outer surface of the flow director.

* * * * *